US010457459B2

(12) United States Patent
Vorobej

(10) Patent No.: US 10,457,459 B2
(45) Date of Patent: Oct. 29, 2019

(54) PACKAGE

(71) Applicant: XPO Logistics Supply Chain, Inc., High Point, NC (US)

(72) Inventor: Anndrea Vorobej, Greensboro, NC (US)

(73) Assignee: XPO Logistics Supply Chain, High Point, NC (US)

( * ) Notice: Subject to any disclaimer, the term of this patent is extended or adjusted under 35 U.S.C. 154(b) by 309 days.

(21) Appl. No.: 15/142,521

(22) Filed: Apr. 29, 2016

(65) Prior Publication Data

US 2016/0318682 A1 Nov. 3, 2016

Related U.S. Application Data

(60) Provisional application No. 62/155,888, filed on May 1, 2015.

(51) Int. Cl.

| | |
|---|---|
| ***B65D 73/00*** | (2006.01) |
| ***B65D 75/22*** | (2006.01) |
| ***A45C 11/10*** | (2006.01) |
| ***B65D 75/24*** | (2006.01) |
| ***B65D 75/54*** | (2006.01) |
| ***A45C 11/12*** | (2006.01) |
| ***A45C 11/16*** | (2006.01) |

(52) U.S. Cl.

CPC ..... *B65D 75/22* (2013.01); *A45C 11/10* (2013.01); *A45C 11/12* (2013.01); *A45C 11/16* (2013.01); *B65D 75/24* (2013.01); *B65D 75/54* (2013.01)

(58) Field of Classification Search

CPC ..... B65D 75/22; B65D 75/24; B65D 75/54; A45C 11/10; A45C 11/12; A45C 11/16

USPC ..... 206/232, 461, 464, 465, 467, 470, 471

See application file for complete search history.

(56) References Cited

U.S. PATENT DOCUMENTS

| | | | | |
|---|---|---|---|---|
| 1,909,020 A | | 5/1933 | Shields | |
| 5,485,919 A | * | 1/1996 | Samberg | B65D 75/24 206/278 |
| 5,878,886 A | * | 3/1999 | Marshall | B65D 75/22 206/348 |

(Continued)

FOREIGN PATENT DOCUMENTS

| | | |
|---|---|---|
| AT | 324 617 | 9/1975 |
| CH | 126 878 | 7/1928 |
| DE | 295 15 811 | 11/1995 |

OTHER PUBLICATIONS

"ram memory clamshell packaging 1870", web page at https://www.youtube.com/watch?v=JFFQPOIIfgE, as available via the Internet, accessed on Mar. 3, 2015.

(Continued)

*Primary Examiner* — Luan K Bui

(74) *Attorney, Agent, or Firm* — Kilpatrick Townsend & Stockton LLP

(57) ABSTRACT

Embodiments of the present invention described herein relate to packages, and particularly to a packages of an article or plurality of articles. The packages described herein can include a first tray, a second tray, a hinge connecting the first tray and the second tray that is configured to enable the first tray and the second tray to pivot relative to each other to a first open position and a second closed position, and a display device. The display device can be positioned between the first tray and the second tray in an interior portion of the package.

19 Claims, 6 Drawing Sheets

(56) References Cited

U.S. PATENT DOCUMENTS

| | | | | |
|---|---|---|---|---|
| 5,954,203 | A * | 9/1999 | Marconi | B65D 43/162 206/464 |
| 6,345,716 | B1 * | 2/2002 | Chapman | B65D 75/32 206/458 |
| 6,905,014 | B2 * | 6/2005 | Eldin | A45C 1/10 206/0.84 |
| 7,066,327 | B2 * | 6/2006 | Baublitz | B65D 75/22 206/303 |
| 7,255,230 | B1 * | 8/2007 | Appelbaum | B65D 73/0057 206/463 |
| 7,303,115 | B1 | 12/2007 | McClymont | |
| 7,556,152 | B2 | 7/2009 | Lechelle | |
| 9,198,476 | B1 * | 12/2015 | Kim | B65B 5/04 |
| 2003/0053896 | A1 | 3/2003 | Kern | |
| 2006/0000738 | A1 * | 1/2006 | Kumakura | B65D 71/08 206/470 |
| 2006/0096887 | A1 | 5/2006 | Morrison | |
| 2006/0278561 | A1 * | 12/2006 | Schierlmann | B65D 75/24 206/575 |
| 2007/0227943 | A1 | 10/2007 | Foushee | |
| 2008/0023472 | A1 | 1/2008 | Brandt | |
| 2009/0321303 | A1 * | 12/2009 | Kang | B65D 43/164 206/703 |
| 2009/0321305 | A1 * | 12/2009 | Watson | B65D 43/164 206/703 |
| 2010/0230312 | A1 * | 9/2010 | Sorrentino | B65D 21/0202 206/369 |
| 2011/0226663 | A1 | 9/2011 | Bushell et al. | |

OTHER PUBLICATIONS

"72 pin ram simm memory module plastic boxed packaging blister clamshell tray", web page at https://www.youtube.com/watch?v=BenzSHIBidw, as available via the Internet, accessed on Mar. 3, 2015.

"Macaron blister packaging, Clamshell Packaging, Used for Macrons, Customized Designs are Accept", web page at http://www.fazendomedia.com/pz5d86e9b-cz564bf5b-macaron-blister-packaging-clamshell-packaging-used-for-macrons-customized-designs-are-accept.html, as available via the Internet, accessed on Mar. 3, 2015.

"Clear blister shell box for macaron BL-005" web page at http://www.food-display-stand.com/Products/Products58.html, as available via the Internet, accessed on Mar. 3, 2015.

Patent Cooperation Treaty, Invitation to Pay Additional Fees, Application No. PCT/US2016/030091 dated Jul. 27, 2016.

* cited by examiner

PACKAGE

CROSS-REFERENCE TO RELATED APPLICATIONS

This application claims priority to U.S. Provisional Patent Application No. 62/155,888, filed May 1, 2015, entitled "Package." The entire disclosure of U.S. Provisional Patent Application No. 62/155,888 is hereby incorporated by reference in its entirety as though fully set forth herein.

TECHNICAL FIELD OF INVENTION

The present invention relates generally to the field of packaging, and particularly to a packaging of an article or plurality of articles.

BACKGROUND

Consumers have become more frequent purchasers of articles or goods via a remote method, for example, by shopping on the Internet. Businesses also provide more services and goods via remote offerings, and in turn, must fulfill transactions related to such offerings of the different services or goods via a remote physical location. With the increased number of transactions occurring without a consumer being present in the same physical location as the article or good, the fulfillment of the order, and the shipment of the article or good, has become an increasingly important part of the transaction.

For some articles or goods, conventional packaging and methods, such as corrugated cardboard boxes and packing peanuts can be sufficient to ship certain articles or goods. Conventional packages can often be inadequate for the shipping of certain articles, for example specialized, custom products. In some cases, packaging is often an after-thought of the shipment process and not integrated into the order fulfillment process. Additionally, conventional packages can often be limited in the number of desirable positions to display certain information, such as product information or shipping information.

The various embodiments of the present description are directed at improving packaging utilized to carry an article or plurality of articles by addressing such concerns and others.

SUMMARY

The terms "invention," "the invention," "this invention," and "the present invention" used in this patent are intended to refer broadly to all of the subject matter of this patent below. Statements containing these terms should be understood not to limit the subject matter described herein or to limit the meaning or scope of the patent below. This summary is a high-level overview of various aspects of the invention and introduces some of the concepts that are further described in the Detailed Description section below. This summary is not intended to identify key or essential features of the described subject matter, nor is it intended to be used in isolation to determine the scope of the described subject matter. The subject matter should be understood by references to appropriate portions of the entire specification of this patent and any or all drawings.

Described herein are some embodiments of a package used to transport an article or plurality of articles. Some embodiments of the packages described herein can provide greater protection for an article positioned in the package from other contents in the package and exterior forces that may be applied during shipment of the package. Some embodiments of the package described herein can provide a package that facilitates the processing, manufacturing, and shipping of the articles positioned in the package.

In some embodiments, a package comprises a first tray having at least one compartment defined by a plurality of walls, a second tray having a compartment defined by a plurality of walls, and a hinge connecting the first tray and the second tray that enables the first tray and the second tray to pivot relative to each other to a open position and a closed position. The plurality of side walls defining the at least one compartment of the first tray define an opening facing the interior of the package for each of the at least one compartment. The plurality of side walls defining the compartment of the second tray define an opening of the compartment facing the interior of the package. The at least one compartment can be used to position an article or plurality of articles during the shipping process. In some embodiments, the compartment of the second tray can be used to position information related to the contents of the package.

In some embodiments, a package comprises a first tray, a second tray, a hinge, and a display device. The first tray can include at least one compartment defined by a first plurality of wall structures wherein the plurality of wall structures define a first opening. The second tray can have at least one compartment defined by a second plurality of wall structures, wherein the plurality of wall structures define a second opening. The hinge connects the first tray and the second tray and can be configured to enable the first tray and the second tray to pivot relative to each other to an open position and a closed position. When the package is in the closed position, the first opening of the at least one compartment of the first tray is oriented to face the second tray and the second opening of the at least one compartment of the second tray is oriented to face the first tray. When the package is in the closed position, the display device can be positioned between the first tray and the second tray in an interior portion of the package.

In some embodiments, a package comprises a first tray, a second tray, a hinge, and a display device. The first tray comprises a first stop surface and a second stop surface. The first tray can include at least one compartment defined by a first plurality of wall structures wherein the plurality of wall structures define a first opening. The second tray comprises a third stop surface and a fourth stop surface. The second tray can have at least one compartment defined by a second plurality of wall structures, wherein the plurality of wall structures define a second opening. The hinge connects the first tray and the second tray. The display device can be positioned between the first tray and the second tray in an interior portion of the package. The display device can include a first end and a second end. The first end of the display device can abut the first stop surface of the first tray and third stop surface of the second tray and the second end of the display device can abut the second stop surface of the first tray and fourth stop surface of the second tray.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
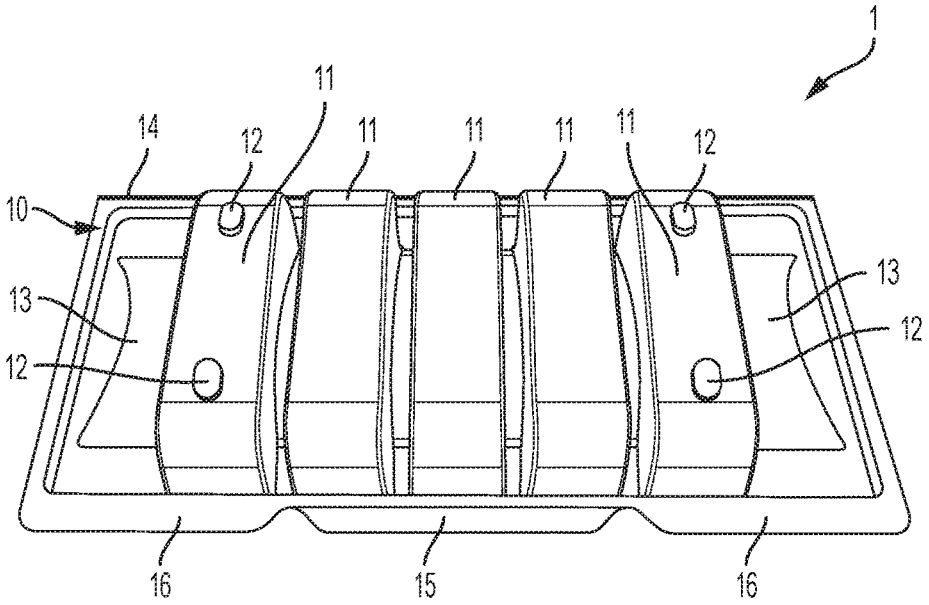
FIG. 1 is a top perspective view of a package in a closed configuration according to one embodiment of the present invention.

Certain aspects and embodiments of the present invention relate to packaging and particularly packaging for an article or a plurality of articles. Some embodiments of the packages described herein can provide greater protection for the articles positioned in the package from other contents in the package and exterior forces that may be applied during a shipping process. Some embodiments of the package described herein can provide a package that facilitates the processing, manufacturing, and shipping of the articles positioned in the package.

In some embodiments, a package comprises a first tray having at least one compartment defined by a plurality of walls, a second tray having a compartment defined by a plurality of walls, and a hinge connecting the first tray and the second tray that enables the first tray and the second tray to pivot relative to each other to a open position and a closed position. The plurality of side walls defining the at least one compartment of the first tray define an opening facing the interior of the package for each of the at least one compartment. The plurality of side walls defining the compartment of the second tray define an opening of the compartment facing the interior of the package. The at least one compartment can be used to position an article or plurality of articles during the shipping process.

In some embodiments, a package comprises a first tray, a second tray, a hinge, and a display device. The first tray comprises a first stop surface and a second stop surface. The first tray can include at least one compartment defined by a first plurality of wall structures wherein the plurality of wall structures define a first opening. The second tray comprises a third stop surface and a fourth stop surface. The second tray can have at least one compartment defined by a second plurality of wall structures, wherein the plurality of wall structures define a second opening. The hinge connects the first tray and the second tray. The display device can be positioned between the first tray and the second tray in an interior portion of the package. The display device can include a first end and a second end. The first end of the display device can abut the first stop surface of the first tray and third stop surface of the second tray, and the second end of the display device can abut the second stop surface of the first tray and fourth stop surface of the second tray.

In some embodiments, a package comprises a first tray, a second tray, a hinge, and a display device. The first tray can include at least one compartment defined by a first plurality of wall structures wherein the first plurality of wall structures define a first opening. The second tray can have at least one compartment defined by a second plurality of wall structures, wherein the second plurality of wall structures define a second opening. The hinge connects the first tray and the second tray and can be configured to enable the first tray and the second tray to pivot relative to each other to a open position and a closed position. When the package is in the closed position, the first opening of the at least one compartment of the first tray is oriented to face the second tray and the second opening of the at least one compartment of the second tray is oriented to face the first tray. When the package is in the closed position, the display device can be positioned between the first tray and the second tray in an interior portion of the package. In some embodiments, the first tray comprises a first stop surface and a second stop surface and the second tray comprises a third stop surface and a fourth stop surface. In some such embodiments, the display device comprises a first end and a second end such that when the display device is positioned in between the first tray and the second tray, the first end of the display device abuts the first stop surface of the first tray and the third stop surface of the second tray, and the second end of the display device abuts the second stop surface of the first tray and the fourth stop surface of the second tray.

In some embodiments, the first stop surface, the second stop surface, the third stop surface, and the fourth stop surface substantially prevent movement of the display device in a first direction. The first direction can be for example lateral movement. In some embodiments, at least one of the first stop surface, the second stop surface, the third stop surface, and the fourth stop surface comprises an arcuate shape.

In some embodiments, the opening of the at least one compartment of the first tray and the opening of the at least one compartment of the second tray define a cavity. In some embodiments, a first tray of the package includes an arcuate structure. In some embodiments, the arcuate structure extends between a plurality of compartments in the first tray. The arcuate structure can provide a top surface to define an elongated compartment for positioning a display device or article. The display device can comprise a top surface and bottom surface. In some aspects at least one of the top surface and the bottom surface can comprise a complementary shape, for example, an arcuate shape. In some embodiments, the display device can be positioned in the arcuate structure extending between a plurality of compartments in the first tray.

In some embodiments, a side wall structure of the at least one compartment of the first tray comprises a first cross sectional shape and the top surface of the display device comprises a third cross sectional shape that is complementary to the first cross section sectional shape. The side wall structure of the at least one compartment of the first tray substantially prevents movement of the display device in a second direction, for example, in a vertical direction and/or a transverse direction. In some embodiments, a side wall structure of the at least one compartment of the second tray comprises a second cross sectional shape and the bottom surface of the display device comprises a fourth cross sectional shape that is complementary to the second cross section sectional shape. The side wall structure of the at least one compartment of the second tray substantially prevents movement of the display device in a second direction, for example, in a vertical direction and/or a transverse direction.

In some embodiments, the display device is configured to display at least one article. The display device can include at least one structure to position an article. For example, the at least one structure can comprise a recess. In some embodiments, the display device comprises at least one perforated region configured to be removed to form that at least one structure.

In some embodiments, the first tray comprises a plurality of compartments. In some embodiments, the first tray comprises five compartments. In other embodiments, any number of compartments can be included, for example, one, two, three, four, six, or seven or more. In some embodiments, the plurality of compartments are positioned at a defined distance apart. The plurality of compartments can provide separate cavities to position an article.

In some embodiments, the second tray comprises a single compartment. In other embodiments, any number of compartments can be included, for example, two, three, four, five, six, or seven or more.

In some embodiments, the at least one compartment comprises dimensions that are greater than the article to be positioned in the compartment. In some such embodiments, the compartment can provide a structure that prevents the article positioned in the compartment from contacting the exterior surfaces of the compartment. For example, when the article is positioned about a display device cannot substantially move laterally, transversely, or vertically, the article remains in a substantially stationary position while present in the package.

In some embodiments, the compartment of the second tray can provide a structure to display information related to the package or article in the package. For example, at least one of shipping address, addressee information, recipient identification, content identification, promotional material, tracking information, product information, article information, date information or other shipping information can be included in the compartment of the second tray. In some embodiments, the second tray is transparent. In some such embodiments, the information included in the compartment of the second tray can be visible to an observer without have to open the package.

In some embodiments, the first tray can include at least one protrusion. The protrusion can provide a structure to facilitate the positioning of the package within a plurality of packages. In some embodiments, the second tray can include at least one recess. The recess can be a complementary shape to the protrusion of the first tray such that the protrusion mates with the recess of the second tray to facilitate stacking and positioning of a plurality of packages.

In some embodiments, the second tray can include at least one protrusion. The protrusion can provide a structure to facilitate the positioning of the package within a plurality of packages. In some embodiments, the first tray can include at least one recess. The recess can be a complementary shape to the protrusion of the second tray such that the protrusion mates with the recess of the first tray to facilitate stacking and positioning of a plurality of packages.

Some embodiments of the package can be made from a plastic material. In some embodiments, the package can be made from polyvinyl chlorides, polypropylenes, polyethylenes, polystyrenes, or a complex of materials of the type polypropylene/ethylene vinyl alcohol (EVOH)/polypropylene, polyethylene terephthalate, polyethylene/polyethylene terephthalate, or polystyrene/EVOH/polyethylene. In some embodiments, the package comprises polyethylene. In some embodiments, the package comprises polypropylene. In some embodiments, the package comprises polyethylene terephthalate. In some embodiments, the package can be made from at least one of polyethylene, polypropylene, and polyethylene terephthalate. In some embodiments, the package can be made by an injection molding operation.

Some embodiments of the package can be made from natural, biodegradable materials, for example pulp or cellulosic materials.

In some embodiments, the package can be made from recycled materials. In some embodiments, the package comprises substantially 100% recyclable material.

In some embodiments, the package is constructed of a transparent material. In other embodiments, the package is constructed of an opaque material. In some embodiments, artwork or visual features can be printed on the package.

Referring to the Figures, the numbers used within each figure are consistent with every other figure. When a specific feature is labeled in one figure with a specific numeral, the same numeral will be used in other figures when denoting that specific feature.

FIG. 1 shows an exemplary embodiment of package 1 in a first closed configuration. The package 1 includes a first tray 10 comprising a plurality of compartments 11. Each compartment 11 is defined by a plurality of walls that define an opening oriented to the interior of the package 1. Each compartment 11 is at least partially separated from the other compartments 11. In FIG. 1, the first tray 10 includes five compartments. In other embodiments, any number of compartments can be included, for example, one, two, three, four, six, or seven or more.

In FIG. 1, a plurality of protrusions 12 are shown on two of the compartments 11. The protrusions 12 can provide a structure to facilitate the positioning of multiple packages. The protrusions 12 have a generally oval shape. In other embodiments, a protrusion can have other shapes, for example, circle, square, or other polygonal shapes.

The first tray 10 includes a first arcuate structure 13 that extends toward the left side of the first tray 10 and a second arcuate structure 13 that extends toward the right side of the first tray 10. The first arcuate structure 13 can include a first stop surface, and the second arcuate structure 13 can include a second stop surface. As shown in FIG. 3, the arcuate structure 13 spans between each of the compartments 11. The arcuate structures 13 in conjunction with arcuate structures 22 of the second tray 20 (shown in FIGS. 2 and 3) provide an additional structure to hold and/or position a display device 40 (further described below in connection with FIGS. 5, 6, 9, and 10). In other embodiments, the structure can comprise a non-arcuate shape, for example, a triangular cross-sectional shape, rectangular cross-sectional shape, or other polygonal shape.

Figure 4:
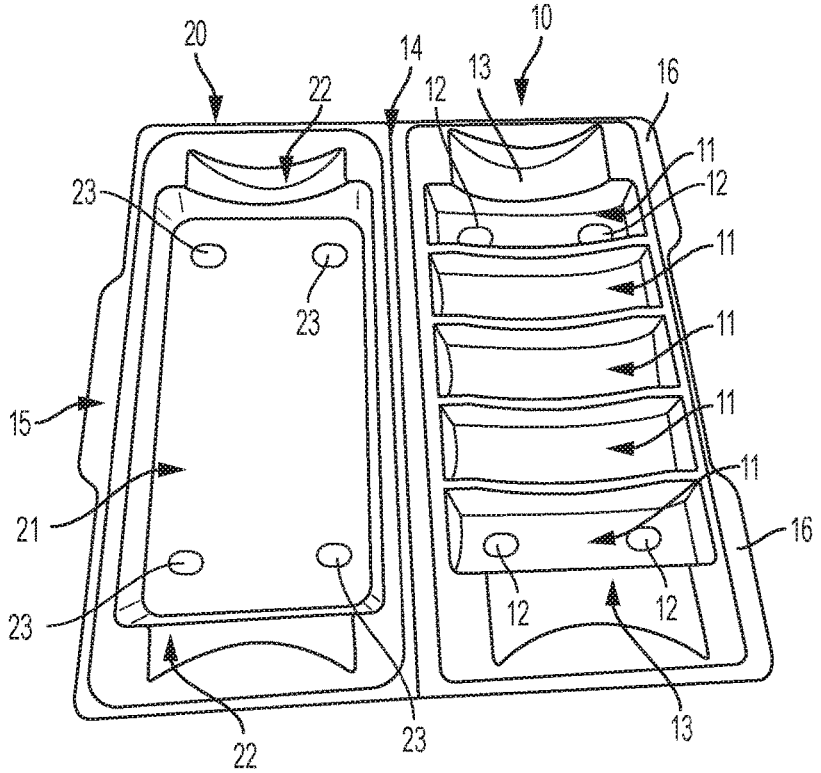
FIG. 4 is a top perspective view of a package in an open configuration according to one embodiment of the present invention.

A back or rear edge of the first tray 10 is coupled to a back or rear edge of the second tray 20 to define a hinge 14. The first tray 10 pivots relative to the second tray 20 around the hinge 14 to rotate between a closed position (for example as shown in FIG. 1) to an open position (for example as shown in FIG. 4). The hinge 14 in FIG. 1 is a living hinge made from the same material as the first tray and the second tray. In other embodiments, the hinge connecting the first tray and second tray can include a discrete hinge connected to each of the first tray and the second tray. The first tray 10 includes tab-like structures 16 to facilitate the opening and closing of the package 1.

Figure 2:
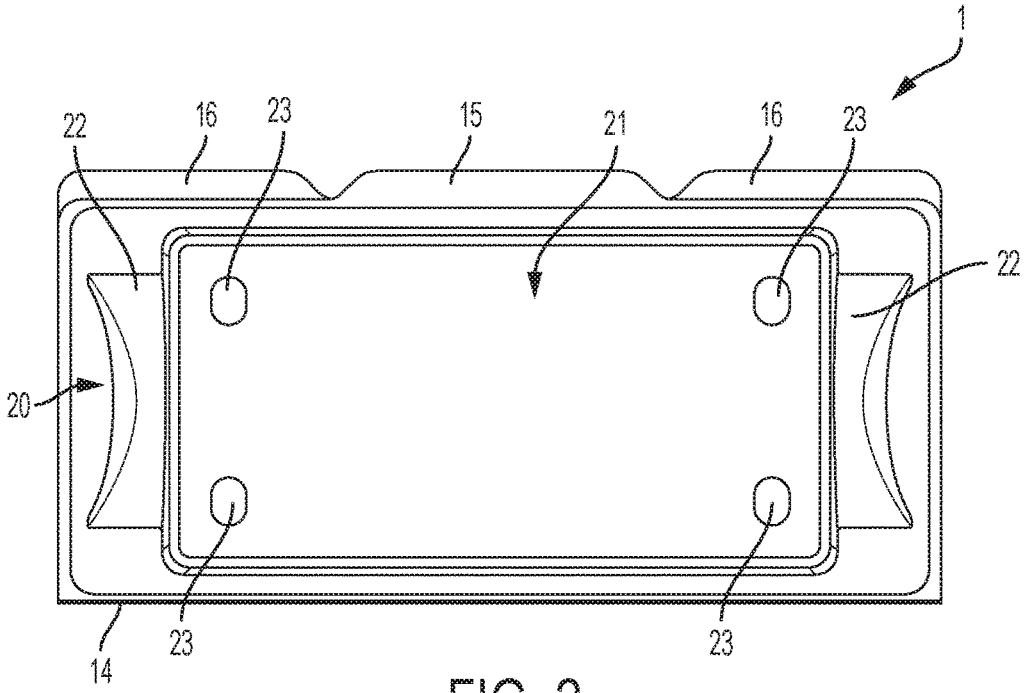
FIG. 2 is a bottom view of a package shown in FIG. 1 according to one embodiment of the present invention.
Figure 3:
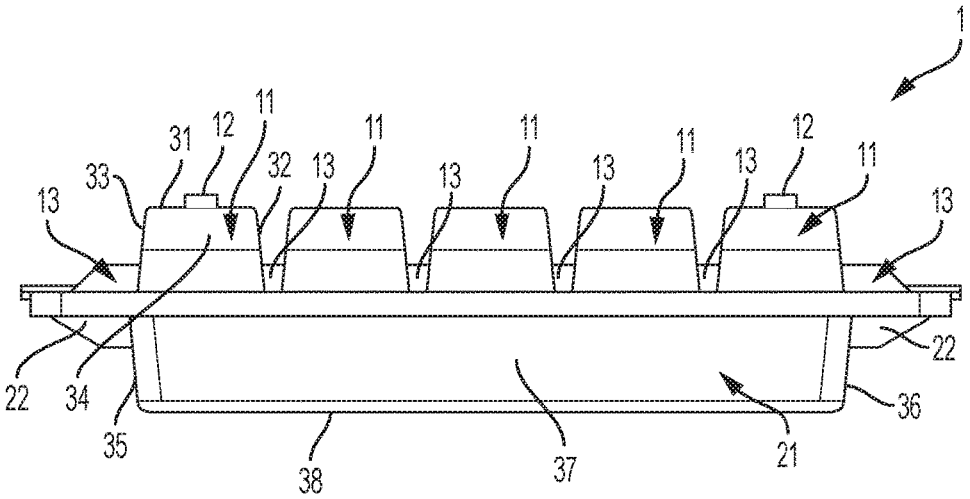
FIG. 3 is a side elevational view of a package shown in FIG. 1 according to one embodiment of the present invention.
Figure 7:
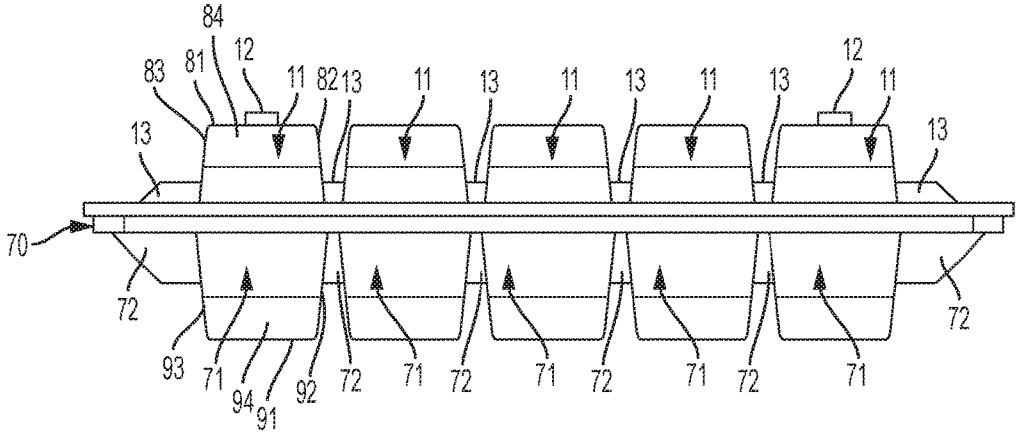
FIG. 7 is a side elevational view of a package according to one embodiment of the present invention.

FIG. 2 shows a bottom view of package 1. The package includes a second tray 20 comprising a compartment 21. The compartment 21 is defined by a plurality of walls that define an opening oriented to the interior of the package 1. The width of the compartment 21 (i.e., the dimension defining the distance from the right side to the left side) spans greater than half of the width of the second tray 20. In FIG. 2, one compartment is shown. In other embodiments, a second tray can include a plurality of compartments, for example, as shown in FIG. 7.

The compartment 21 can provide a surface to facilitate the inclusion of information in or on the package. For example, in embodiments when the package 1 is constructed from a transparent material, product information and shipping information can be included in the compartment 21. The information can be provided in loose paper form in the interior of the package (i.e., not adhered to the package 1) and oriented in a direction such that the information, such as, for example, shipping information or customer identification, is visible when the package 1 is in the closed position. By including the information in a loose form inside the package, the package 1 may be more easily reused for subsequent shipments as no adhesives or other destructive fixture is required to affix the information on the package. The compartment 21 can additionally provide a compartment to include other product material inside the package that is substantially secured by limiting the movement of the information in the compartment. In some embodiments, the information can be adhered or otherwise affixed to and in compartment 21.

In FIG. 2, a plurality of recesses 23 are shown on compartment 21. The recesses 23 can provide a structure to facilitate the positioning of multiple packages. The recesses 23 have a generally oval shape. In other embodiments, a recess can have other shapes, for example, circle, square, or other polygonal shapes. The protrusions 12 of the first tray 10 can align and mate with the complementary recesses 23 of the second tray 20 to facilitate storage and stacking of a plurality of packages.

As described above, the second tray 20 includes a first arcuate structure 22 that extends toward the left side of the second tray 20 and a second arcuate structure 22 that extends from toward the right side of the second tray 20. The first arcuate structure 22 can include a third stop surface, and the second arcuate structure 22 can include a fourth stop surface. The arcuate structures 22 in conjunction with arcuate structures 13 of the first tray 10 (shown in FIGS. 1 and 3) provide an additional structure to hold and/or position a display device 40 (further described below in connection with FIGS. 5, 6, 9, and 10). In other embodiments, the structure can comprise a non-arcuate shape, for example, a triangular cross-sectional shape, a rectangular cross-sectional shape, or other polygonal shape.

The second tray 20 includes a tab-like structure 15 to facilitate the opening and closing of the package 1.

FIG. 3 shows a front elevational view of the package 1. The total width of the plurality of compartments 11 is substantially the same as the total width of the compartment 21. In other embodiments, the total width of the plurality of compartments in the first tray is not substantially the same as the total width of the compartment in the second tray. Each compartment 11 is defined by a plurality of walls. Referring to the compartment 11 positioned in proximity to the left side of the first tray 10, the plurality of walls include a first side wall 33, a second side wall 32, a front wall 34, a top wall 31, and a rear wall (not visible in FIG. 3, but a mirror image of front wall 34). Those of ordinary skill in the art would understand that each of the plurality of compartments 11 includes a similar plurality of walls to define the respective openings of each of the compartments 11.

The arcuate structure 13 extends between each of the compartments 11 to define an upper boundary of a compartment to hold and/or position a display device 40. At least one of the side walls defining at least one of the compartments 11 can include a first cross sectional shape at the interior end. In some such embodiments, a top surface of the display device 40 can comprise a third cross sectional shape that is complementary to the first cross section sectional shape such that the at least one side wall structure of the at least one compartment of the first tray substantially prevents movement of the display device in transverse and/or vertical direction.

The compartment 21 is defined by a plurality of walls. The plurality of walls include a first side wall 35, a second side wall 36, a front wall 37, a bottom wall 38, and a rear wall (not shown in FIG. 3, but a mirror image of front wall 37). At least one of the side walls defining the compartments 21 can include a second cross sectional shape at the interior end. In some such embodiments, a top surface of the display device 40 can comprise a third cross sectional shape that is complementary to the first cross section sectional shape such that the at least one side wall structure of the at least one compartment of the second tray substantially prevents movement of the display device in transverse and/or vertical direction.

Figure 5:
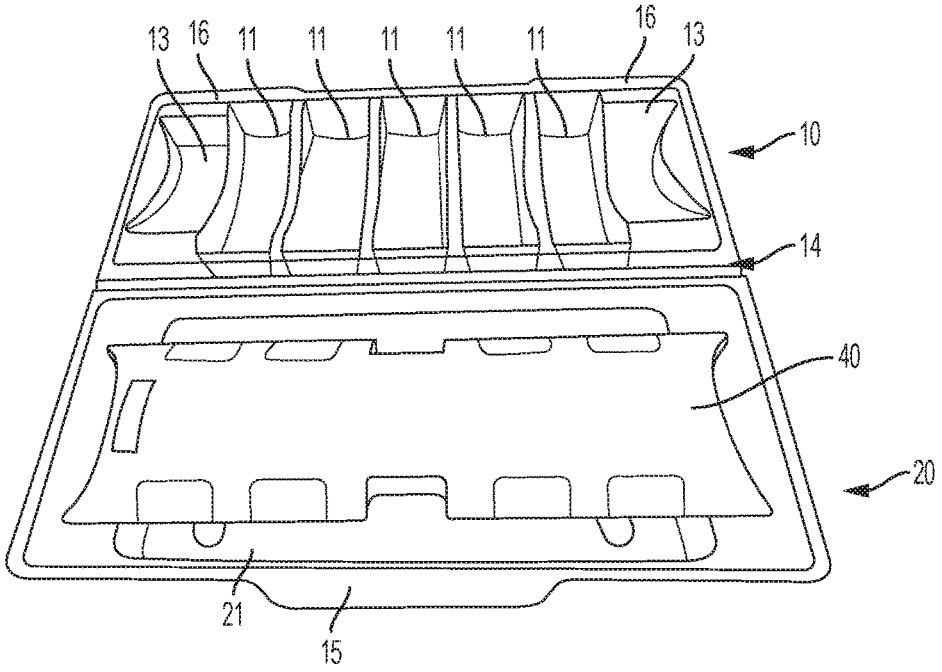
FIG. 5 is a top perspective view of a package in an open configuration according to one embodiment of the present invention.

FIG. 4 shows the package 1 in an open configuration. The first tray 10 is coupled to the second tray 20 by the hinge 14. As shown in FIG. 4, each of the compartments 11 include side walls that have an arcuate-shaped bottom portion that aligns with the shape of the arcuate structure 13. As shown in FIG. 5, the arcuate-shaped bottom portion of the side walls of the compartments 11 permit a display device 40 having a complementary shape to be seated in the package 1. The display device 40 has a pillow-like shape. In other embodiments, the display device may comprise a different shape, for example, a triangular shape or a rectangular shape, or other polygonal shape. In such embodiments, the configuration and shape of the bottom of the side walls of the compartments can be modified to complement the shape of the display device.

Figure 9:
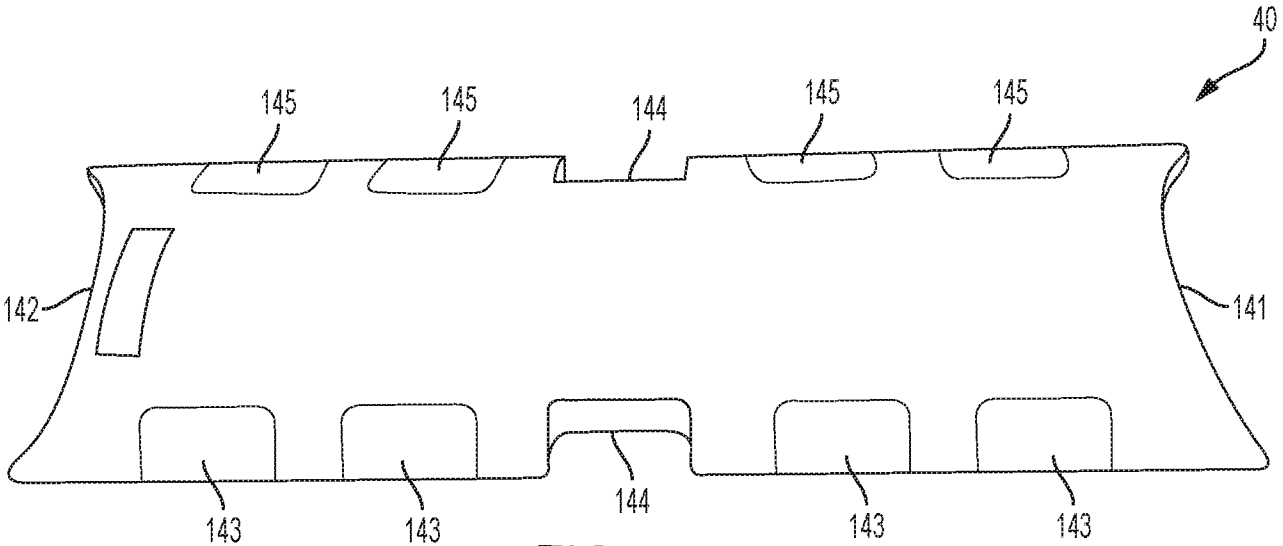
FIG. 9 is a top perspective view of a display device according to one embodiment of the present invention.

The display device 40 is removably secured in the lateral direction by the stop surfaces defined by the arcuate structures 22 of the second tray 20 and arcuate structures 13 of the first tray 10 (when in the package is in the closed position). Any lateral movement of the display device 40 in the second tray is minimized or eliminated as the first end 142 and the second end 141 of the display device 40 (as shown in FIG. 9) abut at least one of the first stop surface, the second stop surface, the third stop surface, and the fourth stop surface of arcuate structure 13 and arcuate structure 22. The term abut used herein refers to a surface or structure that may touch, be in contact, or lean upon another surface and/or be adjacent to the another surface and includes a surface that abut or substantially abuts another surface. FIG. 9 shows an example of the display device 40 having a first end 142 and a second end 141. FIG. 9 is described further below.

Figure 6:
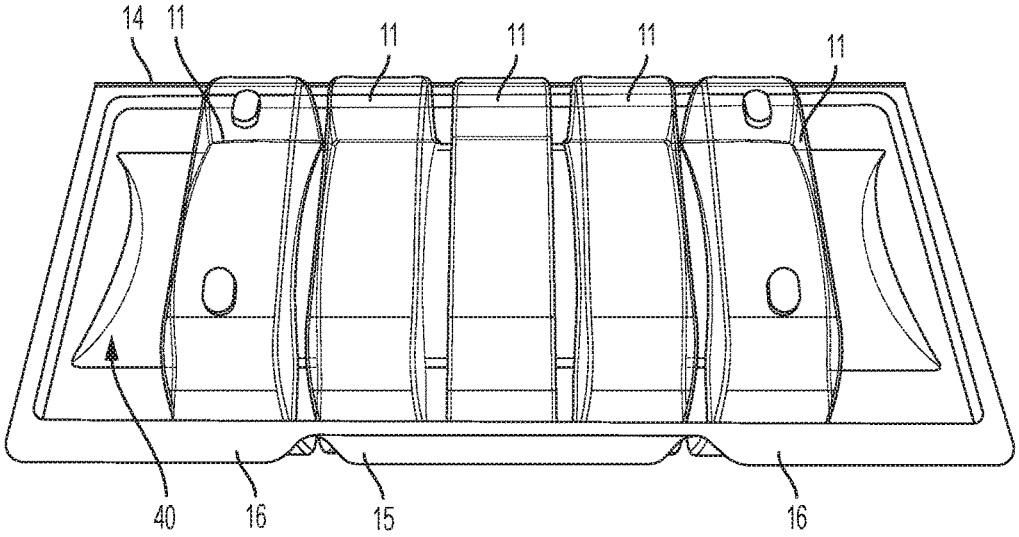
FIG. 6 is a top perspective view of a package shown in FIG. 5 in a closed configuration according to one embodiment of the present invention.

In FIG. 6, the package 1 is shown in the closed configuration. The display device 40 is removably secured in package 1. The arcuate structure 13 provides a structure to minimize or eliminate any lateral movement of the display device 40 in the first tray by the first stop surface and the second stop surface of the arcuate structures 13. At least one side wall of at least one compartment 11 can provide a structure to define the arcuate structure 13 which can provide a structure to minimize or eliminate any vertical movement or transverse movement of the display device 40.

When the display device 40 is positioned as shown in FIG. 6, the display device 40 provides the visual effect of floating or being suspended in the package. The display device 40 provides a structure where an article or plurality of articles can be positioned around the display device 40 for display in each of the compartments 11. For example (and as further shown in FIG. 10), a bracelet or watch can be positioned around the display device and aligned with at least one compartment 11. With the position of the display device 40 being suspended in the package, the bracelet or watch that is aligned with one of the compartments 11 may not abut or contact any of the plurality of walls defining the plurality of compartments 11 and may not abut or contact any of the plurality of walls defining the compartment 21. The dimensions of the plurality of walls defining the compartments 11 and the compartment 21 are of sufficient magnitude to permit an bracelet or watch, or plurality of bracelets or watches, to be positioned within the compartment(s) without abutting or contacting any of the walls. This configuration may be advantageous to protect and guard against the crushing or damage to the bracelet or watch (or other article) during the processing or shipping of the products to the recipient.

Figure 10:
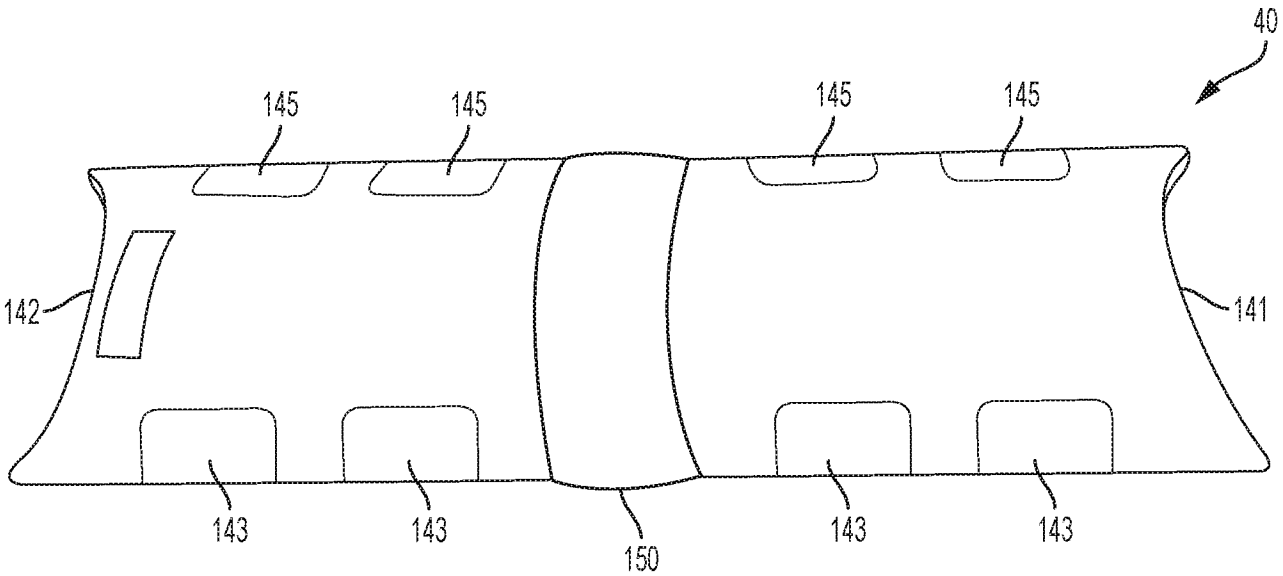
FIG. 10 is a top perspective view of a display device according to one embodiment of the present invention.

FIG. 9 shows a display device 40 have at least one structure 144 to position an article in a package. The at least one structure 144 is a recess. In some embodiments, the display device can include a plurality of perforated structures 143 and 145 that are configured to be removed to provide a plurality of structures to facilitate in the positioning of an article. In FIG. 9, only one of the structures have been shown as removed. The position of structure 144 can correspond to the center compartment 11 shown in FIG. 1 such that an article 150 (as shown in FIG. 10) may be positioned at structure 144, and in turn, the display device be positioned in an interior region of the package. In such embodiments, the article 150 would be located in the center compartment 11 of the first tray. Any number of structure 143 can be removed or included on display device 40.

Returning to the figures generally, the compartments 11 are also positioned at a defined distance apart from one another to facilitate the shipping and tracking process. For example, a plurality of articles can be included in the package 1, and each of the plurality of articles can include some chip or other tracking device. During the packaging and shipping process, each individual article can tracked or read by different machines to verify the location, information, and position of each article at any stage during the manufacturing or packaging process. Some of the tracking devices and methods require minimum distances for separation to accurately track an article. The position of the plurality of compartments according to embodiments of the package described herein can ensure such minimum separation.

FIG. 7 shows another embodiment having a first tray 10 comprising a plurality of compartments 11 and a second tray 70 comprising a plurality of compartments 71. Referring to the compartment 71 positioned in proximity to the left side of the second tray 70, the plurality of walls defining compartment 71 include a first side wall 93, a second side wall 92, a front wall 94, a top wall 91, and a rear wall (not visible in FIG. 7, but a mirror image of front wall 94). Those of ordinary skill in the art would understand that each of the plurality of compartments 71 include similar plurality of walls to define the respective openings of each of compartments 71. The compartments 71 of the second tray 70 provide a similar compartment as compartment 11 to facilitate the packaging and shipping of an article or plurality of articles.

The second tray 70 includes a first arcuate structure 72 that extends toward the left side of the second tray 70 and a second arcuate structure 72 that extends toward the right side of the second tray 70. The first arcuate structure 72 and the second arcuate structure 72 can include at least one stop surface. The arcuate structure 72 extends between each of the compartments 71 to define a lower boundary of a compartment to hold and/or position a display device 40. The arcuate structures 72 in conjunction with arcuate structures 13 of the first tray 13 provide an additional structure to hold and/or position a display device 40.

Figure 8:
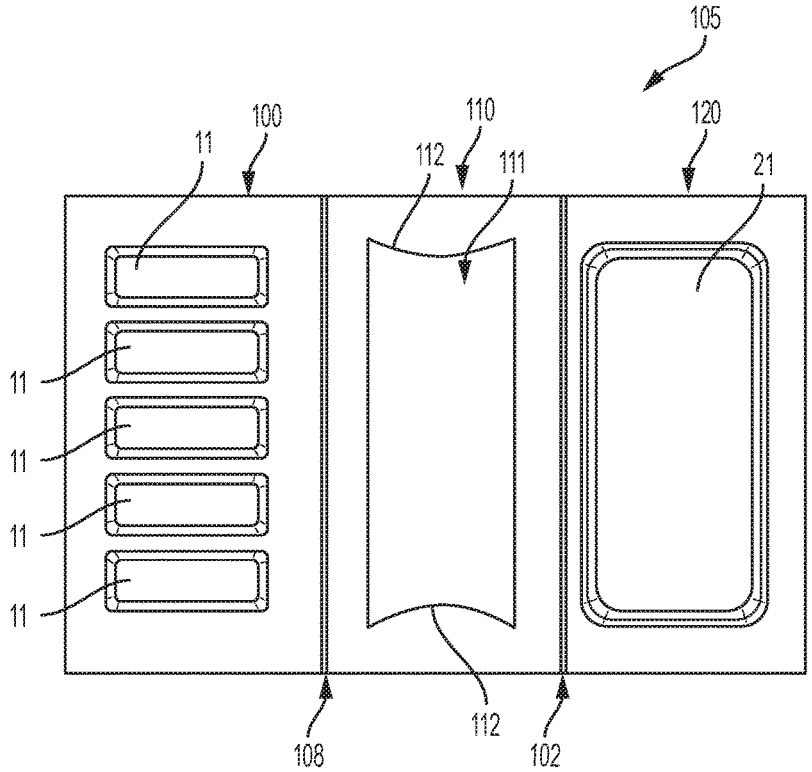
FIG. 8 is top view of a package according to one embodiment of the present invention.

FIG. 8 shows another embodiment comprising a first tray 100, a second tray 110, and a third tray 120. The package 105 shown in FIG. 8 is in a first open configuration. The first tray 100 is coupled to the second tray 110 by a hinge 101. The second tray 110 is coupled to the third tray 120 by a hinge 102. The hinge 101 and hinge 102 are each a living hinge made of the same flexible material as each of the trays.

The first tray 100 includes a plurality of compartments 11 defined by a plurality of walls. The third tray 120 includes a compartment 21 defined by a plurality of walls. The second tray 110 includes a compartment 111 that is defined by a plurality of walls including two side end walls 112 have an arcuate shape. The compartment 111 has a complementary shape as display device 40. Those of ordinary skill in the art can appreciate that different shaped display devices and complementary compartments can be used without departed from the spirit of the invention.

Each of the first tray 100, the second tray 110, and the third tray 120 can pivot relative to one another about the respective hinge 101 and hinge 102. The first tray 100 may pivot to position the first tray 100 on top of the second tray 110, and the third tray 120 may pivot to position the third tray 120 under the second tray 110 to configure the package 105 into a second closed configuration. In the closed configuration, the package 105 can provide a structure to suspend the display device 40 inside the package as described in connection with FIGS. 1-7.

The packages according to embodiments described herein can comprise many advantages and improvements over conventional packages. In some embodiments, the package can provide a plurality of compartments that separate a plurality of articles from contacting each other while positioned in the package. In some embodiments, the package can provide a compartment that allows an article to avoid contacting the outer boundaries of a tray and be suspended or float within the package. In some embodiments, the package can provide increased visibility of the article within the package and increased visibility of product information. In some embodiments, the package can provide a plurality of compartments which position the articles in set, defined positions that can facilitate manufacturing processes and tracking processes.

In some embodiments, the package provides concise compartments having sufficient rigidity that keep an article in a single position, but protect the article from exterior and interior forces that may damage the product. In doing so, the package avoids excess total volume when compared to conventional packaging, i.e., embodiments of the package described herein can reduce the amount of dead space in the package, and in turn, may reduce the costs associated with shipping the package.

In some embodiments, the package can include an article that has personal information embedded in a chip or other logic or storage media. For example, credit card information, registration numbers, or other identifying personal information may be included on the article, such as a bracelet. A manufacturing and packaging process using some embodiments of the package described herein may facilitate the adding of this personal information to the article and allow better tracking and verification of the position of the article that includes the sensitive personal information in a more secure fashion.

In some embodiments, because the package substantially secures the article or plurality of articles in a position, the display device can be removed and presented directly to a recipient without having to adjust the position of the article or articles. In conventional packages, the article or plurality of articles may shift during the shipping process and require a person to adjust the articles into a more visually appealing form for presentation to a recipient. In some embodiments described herein, this adjustment is eliminated or minimized by the presence of the plurality of compartments defining separate and discrete positions at a defined distance apart.

The foregoing description of the embodiments, including illustrated embodiments, of the assemblies, devices, and methods have been presented for the purpose of illustration and description and is not intended to be exhaustive or to limit the invention to the precise forms disclosed. Numerous modifications, adaptations, and uses thereof will be apparent to those skilled in the art without departing from the scope of this invention.

That which is claimed:

1. A package comprising:

a first tray having at least one compartment defined by a first plurality of wall structures, wherein the first plurality of wall structures define a first opening;

a second tray having at least one compartment defined by a second plurality of wall structures, wherein the second plurality of wall structures define a second opening;

a hinge connecting the first tray and the second tray, the hinge configured to enable the first tray and the second tray to pivot relative to each other to an open position and a closed position; and a display device comprising at least one perforated region configured to be removed to form at least one structure, wherein the at least one structure is configured to position an article wherein when the package is in the closed position, the first opening of the at least one compartment of the first tray is oriented to face the second tray and the second opening of the at least one compartment of the second tray is oriented to face the first tray, and wherein when the package is in the closed position, the display device is positioned between the first tray and the second tray in an interior portion of the package.

2. The package of claim 1, wherein the first tray comprises a first stop surface and a second stop surface, and the second tray comprises a third stop surface and a fourth stop surface.

3. The package of claim 2, wherein the display device comprises a first end and a second end such that when the display device is positioned in between the first tray and the second tray, the first end of the display device abuts the first stop surface of the first tray and the third stop surface of the second tray, and the second end of the display device abuts the second stop surface of the first tray and the fourth stop surface of the second tray.

4. The package of claim 3, wherein the first stop surface, the second stop surface, the third stop surface, and the fourth stop surface substantially prevent movement of the display device in a first direction.

5. The package of claim 3, wherein at least one of the first stop surface, the second stop surface, the third stop surface, and the fourth stop surface comprises an arcuate shape.

6. The package of claim 1, wherein the first tray comprises five compartments.

7. The package of claim 1, wherein the at least one compartment of the second tray provides a structure to position information concerning contents of the package, wherein the information comprises at least one of shipping address, addressee information, recipient identification, content identification, promotional material, tracking information, product information, article information, and date information.

8. The package of claim 1, wherein the at least one structure comprises a recess.

9. The package of claim 1, wherein the first tray further comprises at least one protrusion on an exterior surface of the first tray, and the second tray further comprises at least one recess on an exterior surface of the second tray, wherein the at least one protrusion and the at least one recess comprise a complementary shape such that the at least one protrusion is configured to mate with the at least one recess.

10. The package of claim 1, wherein the first tray further comprises at least one recess on an exterior surface of the first tray, and the second tray further comprises at least one protrusion on an exterior surface of the second tray, wherein the at least one protrusion and the at least one recess comprise a complementary shape such that the at least one protrusion is configured to mate with the at least one recess.

11. The package of claim 1, wherein a side wall structure of the at least one compartment of the first tray comprises a first cross sectional shape and wherein a top surface of the display device comprises a third cross sectional shape that is complementary to the first cross section sectional shape such that the side wall structure of the at least one compartment of the first tray substantially prevents movement of the display device in a second direction.

12. The package of claim 1, wherein a side wall structure of the at least one compartment of the second tray comprises a second cross sectional shape and wherein a bottom surface of the display device comprises a fourth cross sectional shape that is complementary to the second cross section sectional shape such that the side wall structure of the at least one compartment of the second tray substantially prevents movement of the display device in a second direction.

13. The package of claim 1, wherein the first tray has a plurality of compartments, and the second tray has a single compartment.

14. A package comprising:

a first tray comprising a first stop surface and a second stop surface, the first tray having at least one compartment defined by a first plurality of wall structures, wherein the first plurality of wall structures define a first opening and wherein the first tray comprises at least one protrusion on an exterior surface of the first tray;

a second tray comprising a third stop surface and a fourth stop surface, the second tray having at least one compartment defined by a second plurality of wall structures, wherein the second plurality of wall structures define a second opening and wherein the second tray comprises at least one recess on an exterior surface of the second tray wherein the at least one protrusion and the at least one recess comprise a complementary shape such that the at least one protrusion is configured to mate with the at least one recess;

a hinge connecting the first tray and the second tray; and a display device comprising a first end and a second end, wherein the display device is positioned between the first tray and the second tray in an interior portion of the package such that the first end abuts the first stop surface and third stop surface and the second end abuts the second stop surface and the fourth stop surface, wherein the display device comprises at least one structure configured to position an article, and wherein the display device comprises at least one perforated region configured to be removed to form the at least one structure.

15. The package of claim 14, wherein the first stop surface, the second stop surface, the third stop surface, and the fourth stop surface substantially prevent movement of the display device in a first direction.

16. The package of claim 14, wherein the at least one structure comprises a recess.

17. A package comprising a first tray comprising a first stop surface and a second stop surface, the first tray having at least one compartment defined by a first plurality of wall structures, wherein the first plurality of wall structures define a first opening;

a second tray comprising a third stop surface and a fourth stop surface, the second tray having at least one compartment defined by a second plurality of wall structures, wherein the second plurality of wall structures define a second opening;

a hinge connecting the first tray and the second tray; and a display device comprising a first end and a second end, wherein the display device is positioned between the first tray and the second tray in an interior portion of the package such that the first end abuts the first stop surface and third stop surface and the second end abuts the second stop surface and the fourth stop surface, wherein the display device comprises at least one structure configured to position an article, and wherein the display device comprises at least one perforated region configured to be removed to form the at least one structure.

18. The package of claim 17, wherein the first stop surface, the second stop surface, the third stop surface, and the fourth stop surface substantially prevent movement of the display device in a first direction.

19. The package of claim 17, wherein the at least one structure comprises a recess.

* * * * *